US008982017B2

(12) United States Patent
Lee et al.

(10) Patent No.: US 8,982,017 B2
(45) Date of Patent: Mar. 17, 2015

(54) PIXEL CIRCUIT OF ORGANIC LIGHT EMITTING DIODE DISPLAY DEVICE FOR COMPENSATING FOR A CHARACTERISTIC DEVIATION OF A DRIVING THIN FILM TRANSISTOR

(75) Inventors: Young-Hak Lee, Paju-si (KR); Geun-Young Kim, Gimhae-si (KR)

(73) Assignee: LG Display Co., Ltd., Seoul (KR)

( * ) Notice: Subject to any disclaimer, the term of this patent is extended or adjusted under 35 U.S.C. 154(b) by 99 days.

(21) Appl. No.: 13/604,243

(22) Filed: Sep. 5, 2012

(65) Prior Publication Data

US 2013/0057532 A1 Mar. 7, 2013

(30) Foreign Application Priority Data

Sep. 5, 2011 (KR) ..... 10-2011-0089883

(51) Int. Cl.
*G09G 3/30* (2006.01)
*G09G 3/32* (2006.01)
*G09G 3/10* (2006.01)

(52) U.S. Cl.
CPC ..... *G09G 3/3225* (2013.01); *G09G 3/3291* (2013.01); *G09G 2300/0852* (2013.01); *G09G 2300/0861* (2013.01); *G09G 2320/045* (2013.01)
USPC ..... 345/76; 315/169.3

(58) Field of Classification Search
CPC ..... G09G 3/325
USPC ..... 345/76
See application file for complete search history.

(56) References Cited

U.S. PATENT DOCUMENTS

2004/0257353 A1* 12/2004 Imamura et al. ..... 345/204
2005/0269959 A1* 12/2005 Uchino et al. ..... 315/169.3
2007/0091029 A1* 4/2007 Uchino et al. ..... 345/76
2008/0225061 A1* 9/2008 Kimura et al. ..... 345/690
2009/0315815 A1* 12/2009 Woo et al. ..... 345/82
2011/0115764 A1* 5/2011 Chung ..... 345/76
2011/0115772 A1* 5/2011 Chung ..... 345/76
2011/0164071 A1* 7/2011 Chung et al. ..... 345/77

* cited by examiner

*Primary Examiner* — Adam J Snyder
(74) *Attorney, Agent, or Firm* — Birch, Stewart, Kolasch & Birch, LLP

(57) ABSTRACT

A pixel circuit of an OLED display device is disclosed. The pixel circuit includes a light emitting element, a driving TFT for driving the light emitting element, a delivery capacitor connected between a first node and a second node, a storage capacitor connected between the second node and a third node, a first reset TFT for initializing the first node to a reference voltage in response to a first reset signal from a first reset line, a second reset TFT for initializing the third node to an initialization voltage in response to the first reset signal from the first reset line, a third reset TFT for initializing the second node to the reference voltage in response to a second reset signal from a second reset line, and a switching TFT for supplying a data voltage to the first node in response to a scan signal from a scan line.

4 Claims, 9 Drawing Sheets

PIXEL CIRCUIT OF ORGANIC LIGHT EMITTING DIODE DISPLAY DEVICE FOR COMPENSATING FOR A CHARACTERISTIC DEVIATION OF A DRIVING THIN FILM TRANSISTOR

This application claims the benefit of Korean Patent Application No. 10-2011-0089883, filed on Sep. 5, 2011, which is hereby incorporated by reference as if fully set forth herein.

BACKGROUND OF THE INVENTION

1. Field of the Invention

The present invention relates to an organic light emitting diode (referred to hereinafter as an OLED) display device, and more particularly, to a pixel circuit of an OLED display device which is capable of compensating for a characteristic deviation of a driving thin film transistor and reducing the influence of a previous frame.

2. Discussion of the Related Art

An OLED display device is a self-emissive device in which an organic light emitting layer emits light by recombination of electrons and holes, and is expected to be a next-generation display device in that it is high in luminance, low in driving voltage and ultra-thin in thickness.

Such an OLED display device includes a plurality of pixels, each of which includes a light emitting element having an organic light emitting layer disposed between an anode and a cathode, and a pixel circuit for independently driving the light emitting element. Pixel circuits may be classified into a voltage type and a current type. A voltage-type pixel circuit employs an external driving circuit simpler in configuration than a current-type pixel circuit and is suited to a high-speed operation, so that it may be highly applicable as a pixel circuit for an OLED television (TV).

The voltage-type pixel circuit mainly includes a switching thin film transistor (referred to hereinafter as a TFT), a capacitor, and a driving TFT. The switching TFT charges a voltage corresponding to a data signal in the capacitor in response to a scan pulse, and the driving TFT controls the amount of current to be supplied to an OLED based on the voltage charged in the capacitor to adjust the amount of light to be emitted from the OLED.

However, a conventional pixel circuit has a disadvantage in that the threshold voltage Vth of a driving TFT is non-uniform by positions by reason of a process deviation, etc., resulting in unevenness in luminance, or the threshold voltage varies with time by the same reason, resulting in a reduction in luminance, thereby reducing lifespan. To solve this, the voltage-type pixel circuit has adopted a method of detecting and compensating for the threshold voltage of the driving TFT.

For example, in a conventional pixel circuit disclosed in Korean Patent Laid-open Publication No. 2008-0001482, the threshold voltage of a driving TFT is detected by connecting the gate and drain of the driving TFT with each other through a separate switching TFT, and a data voltage is compensated for by an amount corresponding to the detected threshold voltage. Also, in the conventional pixel circuit, a light-emission switching TFT, connected in series between the driving TFT and an OLED, is used to turn off light emission of the OLED when the threshold voltage is detected.

However, in the conventional pixel circuit, the threshold voltage of the driving TFT can be compensated, but the threshold voltage of the light-emission switching TFT connected in series between the driving TFT and the OLED cannot be compensated, resulting in unevenness in luminance due to a difference in the threshold voltage of the light-emission switching TFT. On the other hand, in order to solve the problem with the light-emission switching TFT, the light-emission switching TFT may be omitted. In this case, the OLED may emit light even in a period other than a light emission period, thereby increasing a black luminance, which may lead to a reduction in contrast.

Also, in the conventional pixel circuit, the gate and source of the driving TFT may be influenced by data of a previous frame, thereby making accurate data input impossible.

SUMMARY OF THE INVENTION

Accordingly, the present invention is directed to a pixel circuit of an organic light emitting diode display device that substantially obviates one or more problems due to limitations and disadvantages of the related art.

An object of the present invention is to provide a pixel circuit of an organic light emitting diode display device which is capable of preventing an organic light emitting diode from unnecessarily emitting light even under the condition of removing a light-emission switching thin film transistor, and minimizing the influence of a previous frame.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a pixel circuit of an organic light emitting diode display device includes a light emitting element, a driving thin film transistor (TFT) for driving the light emitting element, a delivery capacitor connected between a first node and a second node, the second node being connected with the driving TFT, a storage capacitor connected between the second node and a third node, the third node being connected between the driving TFT and the light emitting element, a first reset TFT for initializing the first node to a reference voltage in response to a first reset signal from a first reset line, a second reset TFT for initializing the third node to an initialization voltage in response to the first reset signal from the first reset line, a third reset TFT for initializing the second node to the reference voltage in response to a second reset signal from a second reset line, and a switching TFT for supplying a data voltage to the first node in response to a scan signal from a scan line.

In an initialization period, the first to third reset TFTs may be turned on to initialize the first and second nodes to the reference voltage and initialize the third node to the initialization voltage.

In a threshold voltage detection period, the third reset TFT may supply the reference voltage to the second node such that a voltage at the third node rises through the driving TFT until the storage capacitor detects a threshold voltage of the driving TFT.

In a data input period, the delivery capacitor may deliver the data voltage, supplied to the first node through the switching TFT, to the second node such that the storage capacitor is charged with a difference voltage between the second node and the third node.

In a light emission period, the driving TFT may control current supplied to the light emitting element based on the voltage charged in the storage capacitor.

In the initialization period and the threshold voltage detection period, the voltage at the third node may be lower than a low-level voltage connected with a cathode of the light emitting element such that a negative bias is applied to the light emitting element.

The driving TFT may supply output current thereof to the light emitting element, the output current being proportional to a difference voltage between the data voltage and the reference voltage.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
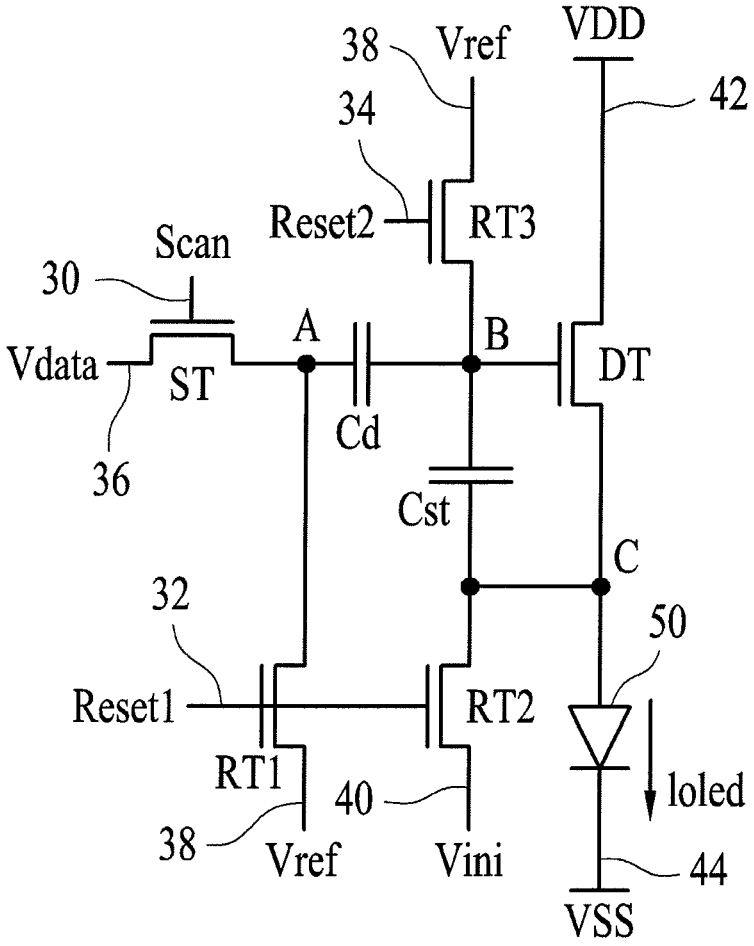
FIG. 1 is an equivalent circuit diagram of a pixel circuit of an OLED display device according to an embodiment of the present invention.
Figure 2:
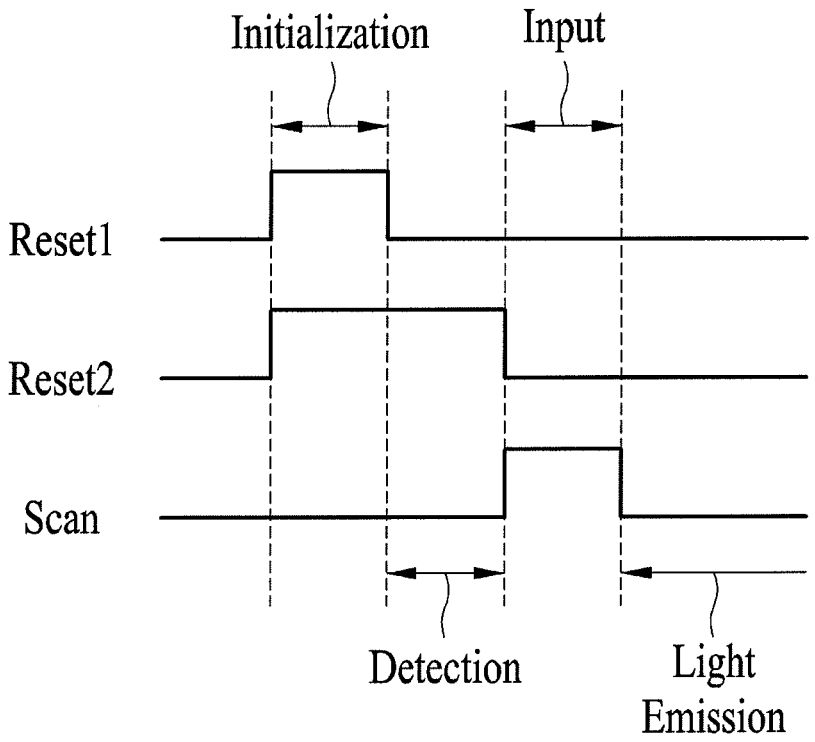
FIG. 2 is a driving waveform diagram of the pixel circuit of FIG. 1.

FIG. 1 is an equivalent circuit diagram of a pixel circuit of an OLED display device according to an embodiment of the present invention, and FIG. 2 is a driving waveform diagram of the pixel circuit of FIG. 1.

Referring to FIG. 1, in order to independently drive an OLED 50, the pixel circuit according to the present embodiment has a 5T2C structure consisting of five TFTs including a driving TFT DT, a switching TFT ST and first to third reset TFTs RT1, RT2 and RT3, and two capacitors including a storage capacitor Cst and a delivery capacitor Cd. Although all of the five TFTs DT, ST, RT1, RT2 and RT3 are illustrated in FIG. 1 as being of n type, they may be of p type.

Also, the pixel circuit shown in FIG. 1 includes a scan line 30 for supplying a scan signal Scan, first and second reset lines 32 and 34 for supplying first and second reset signals Reset1 and Reset2, respectively, a data line 36 for supplying a data voltage Vdata, a reference voltage line 38 for supplying a reference voltage Vref, an initialization voltage line 40 for supplying an initialization voltage Vini, a high-level voltage line 42 for supplying a high-level voltage VDD, and a low-level voltage line 44 for supplying a low-level voltage VSS lower than the high-level voltage VDD. The reference voltage Vref may be lower than the high-level voltage VDD and higher than or equal to the low-level voltage VSS. The initialization voltage Vini may be a voltage lower than the low-level voltage VSS, for example, a gate low voltage of each of the scan signal Scan and reset signals Reset1 and Reset2.

The OLED 50 is connected in series with the driving TFT DT between the high-level voltage line 42 and the low-level voltage line 44. The OLED 50 has an anode connected with the driving TFT DT, a cathode connected with the low-level voltage line 44, and a light emitting layer disposed between the anode and the cathode. The light emitting layer includes an electron injection layer, an electron transport layer, an organic light emitting layer, a hole transport layer and a hole injection layer sequentially stacked between the cathode and the anode. In the OLED 50, when a positive bias is applied between the anode and the cathode, electrons from the cathode are supplied to the organic light emitting layer via the electron injection layer and the electron transport layer, and holes from the anode are supplied to the organic light emitting layer via the hole injection layer and the hole transport layer. In the organic light emitting layer, light is emitted from a fluorescent or phosphorescent material in proportion to current owing to recombination of the supplied electrons and holes. The OLED 50 emits light due to application of the positive bias only in a light emission period, and emits no light due to application of a negative bias in other periods. Therefore, a black luminance may be prevented from being increased due to emission of light in unnecessary periods.

The first reset TFT RT1 has a gate electrode connected to the first reset line 32, a first electrode connected to the reference voltage line 36, and a second electrode connected to a node A connected between the switching TFT ST and the delivery capacitor Cd. The second reset TFT RT2 has a gate electrode connected to the first reset line 32, a first electrode connected to the initialization voltage line 40, and a second electrode connected to a node C connected between the driving TFT DT and the OLED 50. The third reset TFT RT3 has a gate electrode connected to the second reset line 34, a first electrode connected to the reference voltage line 38, and a second electrode connected to a node B connected between the delivery capacitor Cd and the gate electrode of the driving TFT DT. The first electrode and second electrode of each of the first to third reset TFTs RT1, RT2 and RT3 become a source electrode and a drain electrode according to the direction of current, respectively. The first and second reset TFTs RT1 and RT2 initialize the node A to the reference voltage Vref and the node C to the initialization voltage Vini in an initialization period, respectively, in simultaneous response to the first reset signal Reset1 from the first reset line 32. The third reset TFT RT3 initializes the node B to the reference voltage Vref in the initialization period and a threshold voltage detection period in response to the second reset signal Reset2 from the second reset line 34.

The switching TFT ST has a gate electrode connected to the scan line 30, a first electrode connected to the data line 36, and a second electrode connected to the node A. The first electrode and the second electrode become a source electrode and a drain electrode according to the direction of current, respectively. The switching TFT ST supplies the data voltage Vdata to the node A in a data input period in response to the scan signal Scan from the scan line 30.

The driving TFT DT has a gate electrode connected to the node B, a first electrode connected to the node C, and a second electrode connected to the high-level voltage line 42. The first electrode and the second electrode become a source electrode and a drain electrode according to the direction of current, respectively. The driving TFT DT controls current supplied from the high-level voltage line 42 to the OLED 50 according to a voltage at the node B, namely, a gate voltage to drive the OLED 50.

The storage capacitor Cst is connected between the node B and the node C, and the delivery capacitor Cd is connected between the node A and the node B. The storage capacitor Cst detects and compensates for the threshold voltage Vth of the driving TFT DT such that the driving TFT DT is driven according to the data voltage Vdata without the influence of the threshold voltage Vth. The delivery capacitor Cd supplies the data voltage Vdata to the node B.

The pixel circuit of FIG. 1 is sequentially driven in the initialization period, the threshold voltage detection period, the data input period and the light emission period, as shown in FIG. 2.

Figure 3:
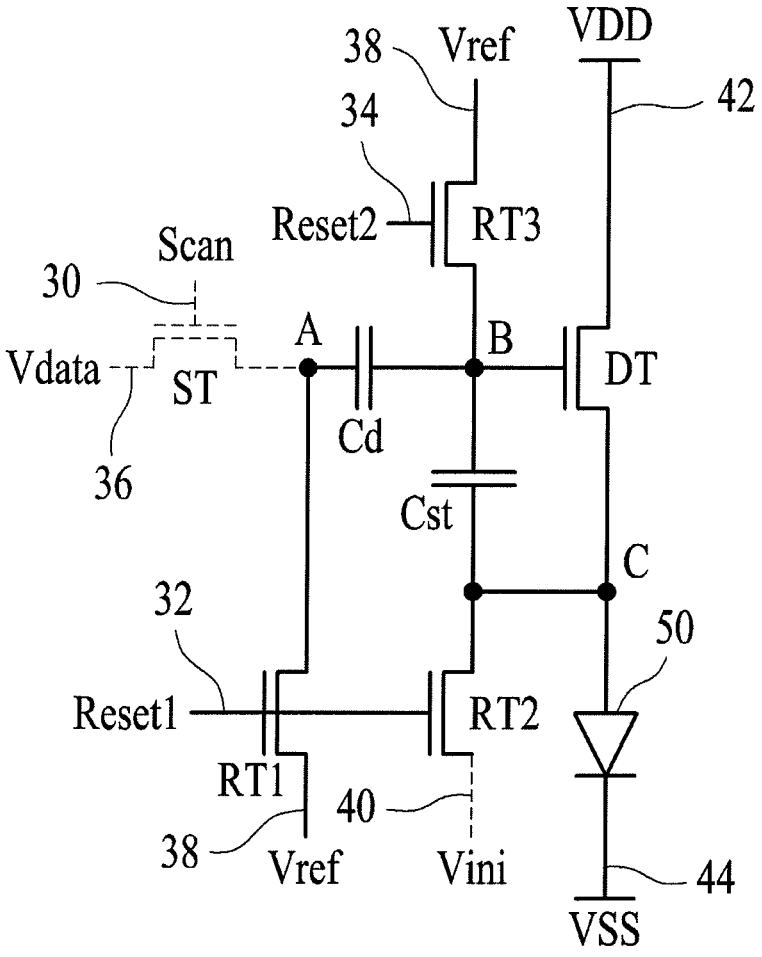
FIG. 3 is a circuit diagram illustrating an operation of the pixel circuit of FIG. 1 in an initialization period in FIG. 2.
Figure 4:
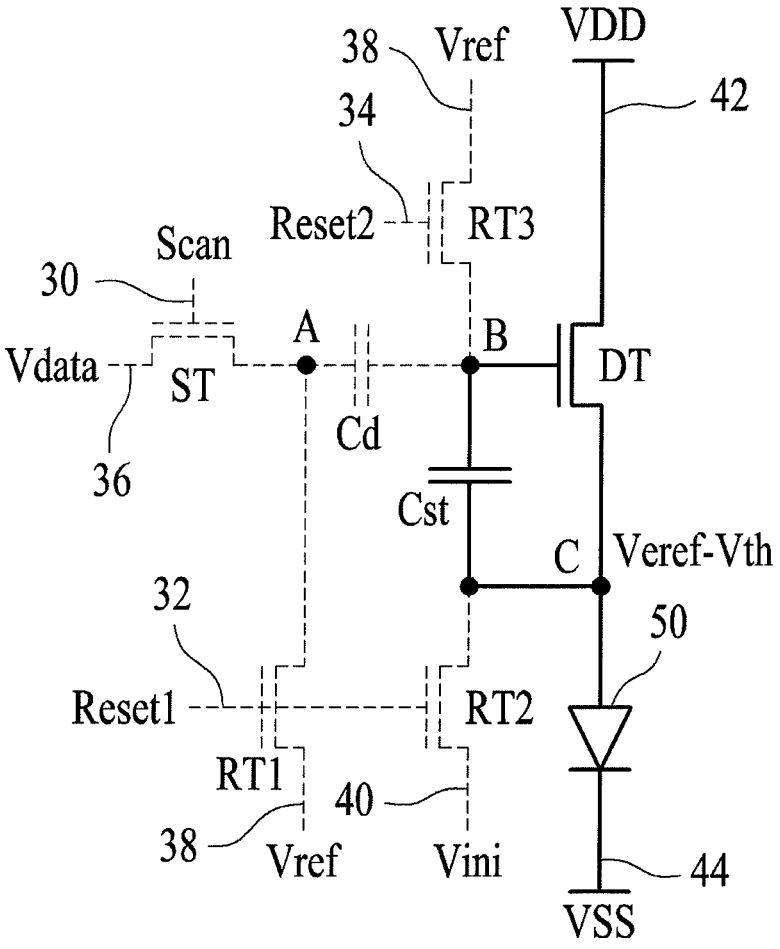
FIG. 4 is a circuit diagram illustrating an operation of the pixel circuit of FIG. 1 in a threshold voltage detection period in FIG. 2.
Figure 5:
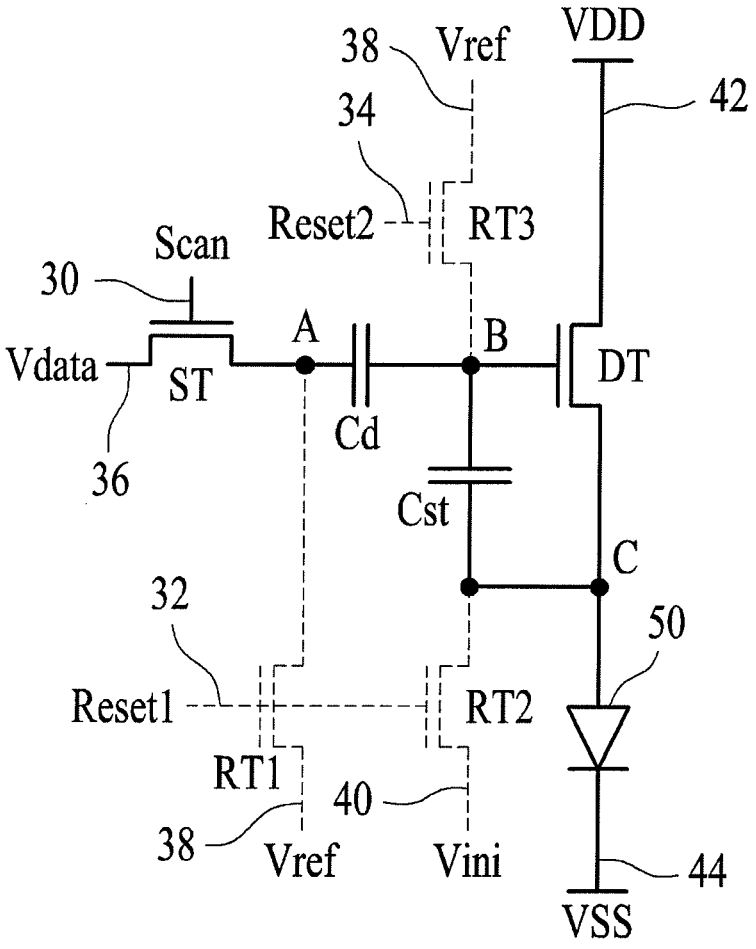
FIG. 5 is a circuit diagram illustrating an operation of the pixel circuit of FIG. 1 in a data input period in FIG. 2.
Figure 6:
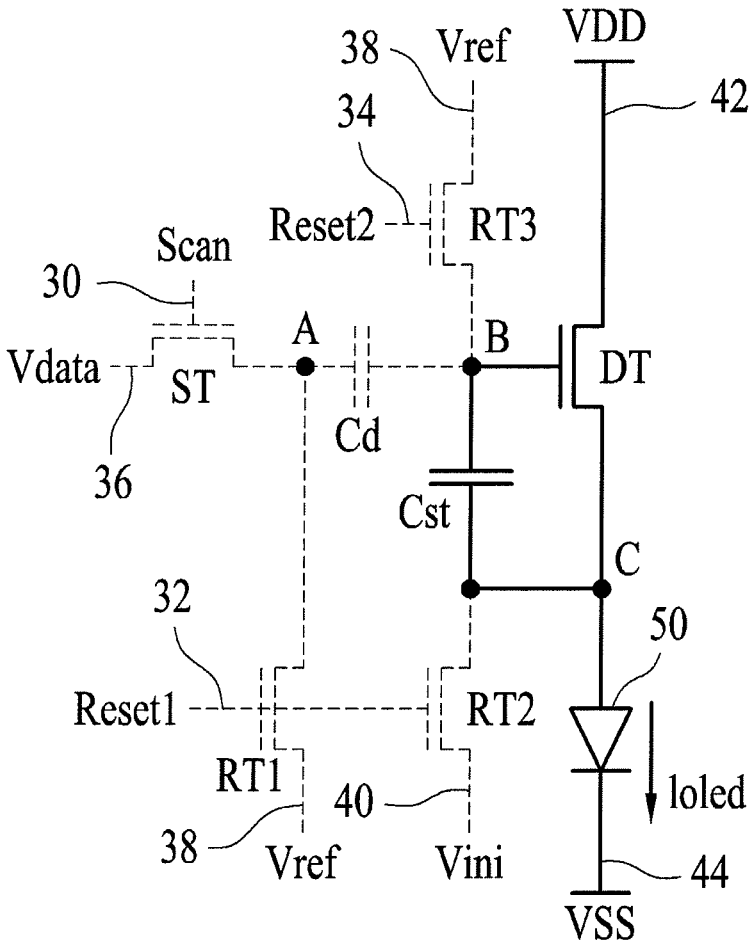
FIG. 6 is a circuit diagram illustrating an operation of the pixel circuit of FIG. 1 in a light emission period in FIG. 2.

FIGS. 3 to 6 are equivalent circuit diagrams sequentially illustrating a process of the pixel circuit of FIG. 1 operating according to a driving waveform of FIG. 2. In detail, FIG. 3 illustrates an operation of the pixel circuit in the initialization period in FIG. 2, FIG. 4 illustrates an operation of the pixel circuit in the threshold voltage detection period in FIG. 2, FIG. 5 illustrates an operation of the pixel circuit in the data input period in FIG. 2, and FIG. 6 illustrates an operation of the pixel circuit in the light emission period in FIG. 2.

The initialization period of FIG. 3 is a period in which the node A and node B are initialized to the reference voltage Vref and the node C is initialized to the initialization voltage Vini, owing to turning-on of the first to third reset TFTs RT1, RT2 and RT3. The threshold voltage detection period of FIG. 4 is a period in which the storage capacitor Cst detects the threshold voltage Vth of the driving TFT DT owing to turning-on of the third reset TFT RT3. The data input period of FIG. 5 is a period in which the switching TFT ST is turned on to supply the data voltage Vdata, and the storage capacitor Cst stores the threshold voltage Vth-compensated data voltage Vdata. The light emission period of FIG. 6 is a period in which the driving TFT DT turns on the OLED 50 in response to a voltage supplied from the storage capacitor Cst.

Because all of the five TFTs constituting the pixel circuit shown in FIGS. 3 to 6 are of n type, they are turned on by a gate high voltage Vgh which is a gate on voltage shown in FIG. 2 and turned off by a gate low voltage Vgl which is a gate off voltage shown in FIG. 2.

In the initialization period of FIG. 3, the first and second reset TFTs RT1 and RT2 are turned on by the gate on voltage of the first reset signal Reset1 supplied from the first reset line 32, the third reset TFT RT3 is turned on by the gate on voltage of the second reset signal Reset2 supplied from the second reset line 34, and the switching TFT ST is turned off by the gate off voltage of the scan signal Scan supplied from the scan line 30. Accordingly, the node A is initialized to the reference voltage Vref supplied through the turned-on first reset TFT RT1, the node B is initialized to the reference voltage Vref supplied through the turned-on third reset TFT RT3, and the node C is initialized to the initialization voltage Vini supplied through the turned-on second reset TFT RT2. As a result, the nodes A, B and C may be initialized such that they are not influenced by a previous frame. In this initialization period, the initialization voltage Vini, which is lower than the low-level voltage VSS, is supplied to the node C, so that the negative bias is applied to the OLED 50. Therefore, the OLED 50 does not emit light, thereby preventing an increase in black luminance.

In the threshold voltage detection period of FIG. 4, the first and second reset TFTs RT1 and RT2 are turned off by the gate off voltage of the first reset signal Reset1 supplied from the first reset line 32, the third reset TFT RT3 is kept on by the gate on voltage of the second reset signal Reset2 supplied from the second reset line 34, and the switching TFT ST is kept off by the gate off voltage of the scan signal Scan supplied from the scan line 30. Accordingly, the driving TFT DT is turned on by the reference voltage Vref supplied to the node B, so that current begins to flow through the driving TFT DT, thereby causing the voltage at the node C to rise. As a result, the detection of the threshold voltage Vth of the driving TFT DT is started and the voltage at the node C is raised by output current from the driving TFT DT. At the time that the voltage stored in the storage capacitor Cst reaches the threshold voltage Vth of the driving TFT DT, namely, the voltage at the node C reaches a voltage of "reference voltage Vref-threshold voltage Vth", the detection of the threshold voltage Vth is completed. In this threshold voltage detection period, because the voltage (Vref-Vth) at the node C is lower than the low-level voltage VSS, the negative bias is applied to the OLED 50. Therefore, the OLED 50 does not emit light, thereby preventing an increase in black luminance.

In the data input period of FIG. 5, the switching TFT ST is turned on by the gate on voltage of the scan signal Scan supplied from the scan line 30, so as to supply the data voltage Vdata supplied from the data line 36 to the node A. Also, the first to third reset TFTs RT1, RT2 and RT3 are turned off by the gate off voltages of the first and second reset signals Reset1 and Reset2. The delivery capacitor Cd supplies the data voltage Vdata supplied to the node A to the node B. As a result, the storage capacitor Cst is charged with a difference voltage Vgs between the data voltage Vdata supplied to the node B and the voltage of "reference voltage Vref-threshold voltage Vth" supplied to the node C, and keeps the charged voltage Vgs till the light emission period of FIG. 6.

In the light emission period of FIG. 6, the switching TFT ST is turned off by the gate off voltage of the scan signal Scan supplied from the scan line 30, and the first to third reset TFTs RT1, RT2 and RT3 are kept off by the gate off voltages of the first and second reset signals Reset1 and Reset2. As a result, the driving TFT DT supplies its output current Ioled to the OLED 50 based on the voltage Vgs charged in the storage capacitor Cst, so that the OLED 50 emits light. At this time, the output current Ioled supplied from the driving TFT DT to the OLED 50 can be expressed by the following equation 1.

$$Ioled=k(Vgs-Vth)^2$$

$$Vgs=V\text{data}-(V\text{ref}-Vth)$$

$$\rightarrow Ioled=k(V\text{data}-V\text{ref})^2 \qquad \text{[Equation 1]}$$

Here, k is a proportional factor which is determined depending on the structure (channel width and length) and physical characteristics of the driving TFT DT. From the above equation 1, it can be seen that the item of the threshold voltage Vth in the voltage determining the output current Ioled of the driving TFT DT is offset so that the output current Ioled is proportional to a difference voltage (Vdata−Vref) between the data voltage Vdata and the reference voltage Vref. Accordingly, it can be seen that the output current Ioled is not influenced by a deviation in the threshold voltage Vth of the driving TFT DT.

Figure 7:
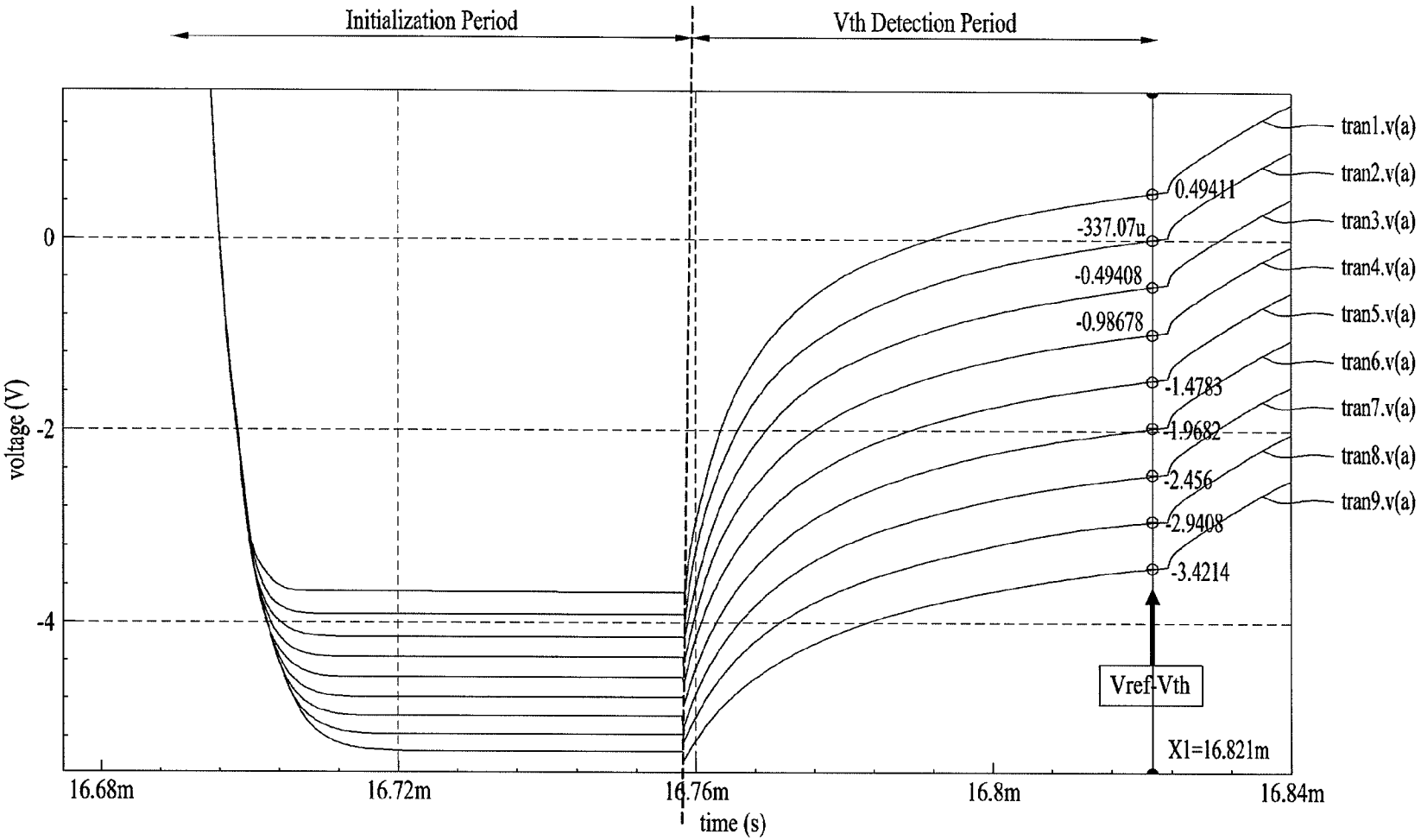
FIG. 7 is a graph illustrating voltages measured at a node C in the initialization period of FIG. 3 and the threshold voltage detection period of FIG. 4.

FIG. 7 is a graph illustrating results of measurement of the voltage at the node C in the pixel circuit according to the present invention in the initialization period and the threshold voltage detection period.

Referring to FIG. 7, it can be seen that the voltage at the node C rises from the initialization voltage Vini to the voltage (Vref-Vth) in the initialization period and the threshold voltage detection period when nine driving TFTs DT1 to DT9 have different threshold voltages Vth as in a table 1 below. Therefore, it can be seen that the storage capacitor Cst detects and stores the threshold voltage Vth in the threshold voltage detection period.

TABLE 1

| | DT1 | DT2 | DT3 | DT4 | DT5 | DT6 | DT7 | DT8 | DT9 |
|---|---|---|---|---|---|---|---|---|---|
| Vth (V) | −2 | −1.5 | −1 | −0.5 | 0 | 0.5 | 1 | 1.5 | 2 |
| Vref-Vth (V) | 0.4 | 0.3 | −0.4 | −0.9 | −1.4 | −1.9 | −2.4 | −2.9 | −3.4 |

Figure 8A:
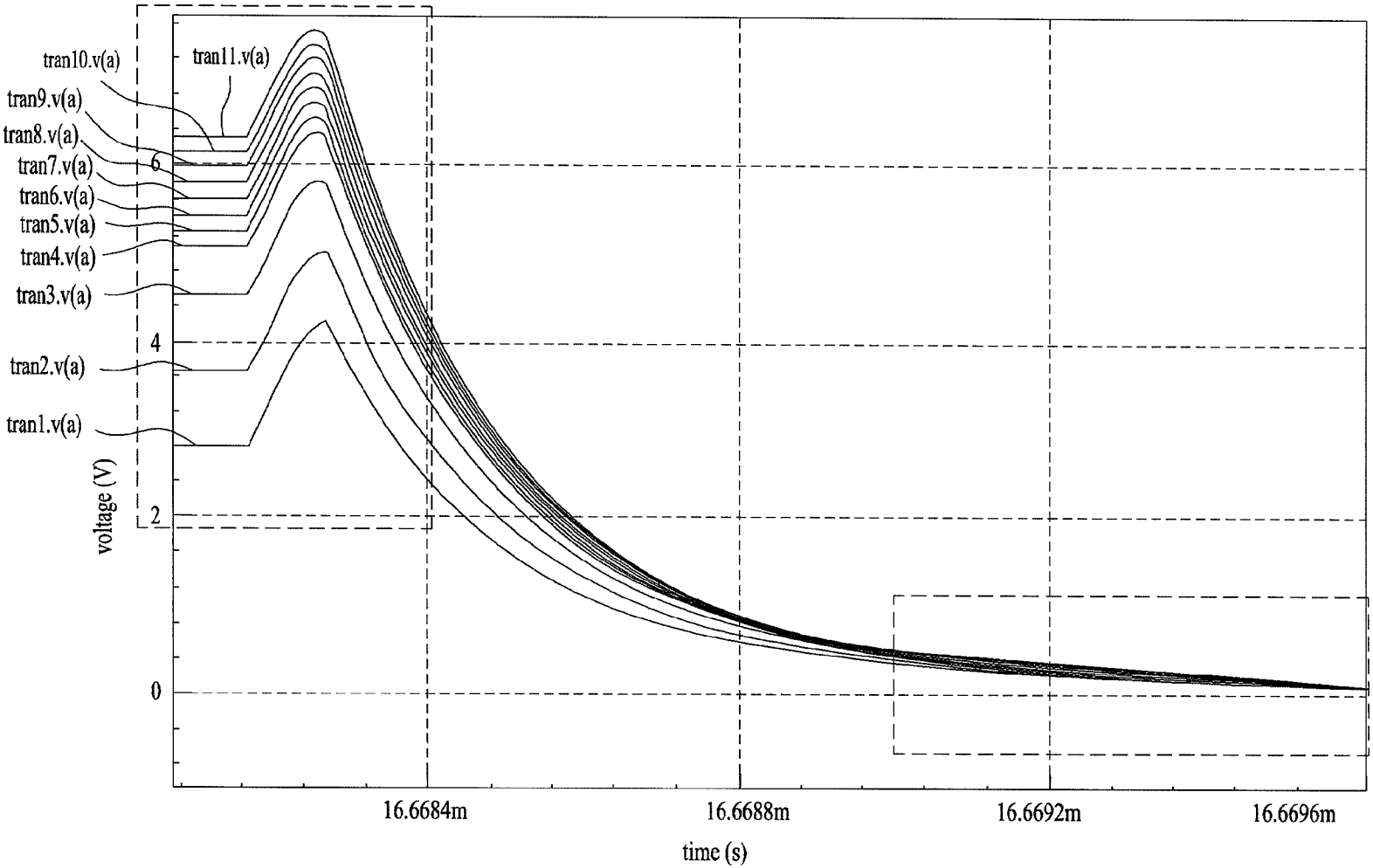
FIGS. 8A and 8B are graphs illustrating voltages measured at a node B and the voltages measured at the node C in the initialization period of FIG. 3.
Figure 8B:
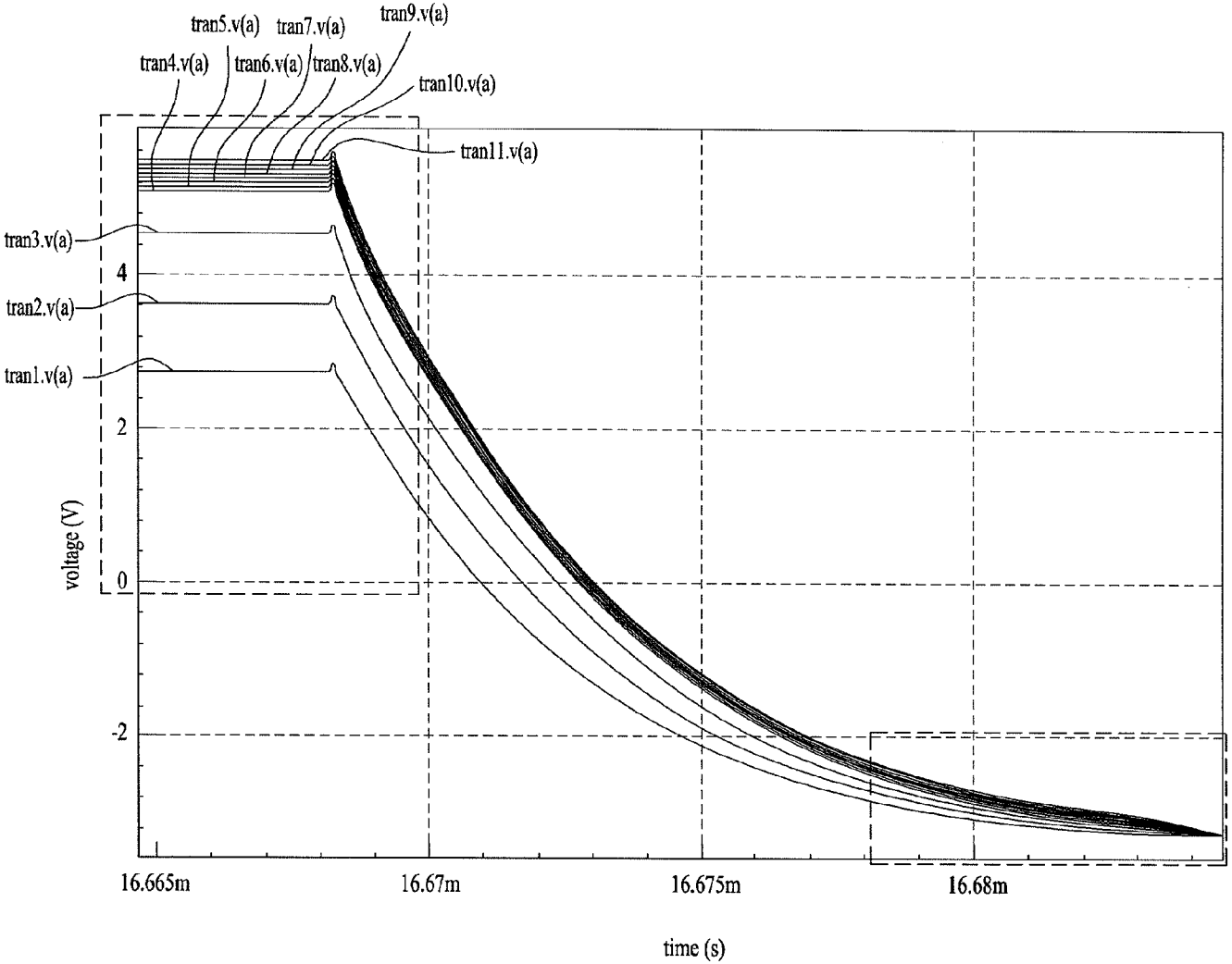

FIGS. 8A and 8B are graphs illustrating results of measurement of the voltages at the node B and node C in the pixel circuit according to the present invention.

Referring to FIGS. 8A and 8B, it can be seen that the node B (gate) and node C (source) of the driving TFT, supplied with various data voltages Vdata in a previous frame, are initialized respectively to the reference voltage Vref and initialization voltage Vini in the initialization period, thereby making it possible to prevent the influence of the previous frame.

As described above, in the pixel circuit of the OLED display device according to the present invention, the threshold voltage of the driving TFT is detected and compensated for through the use of the storage capacitor connected between the gate and source of the driving TFT. Therefore, the OLED can emit light using current proportional to the difference voltage between the data voltage and the reference voltage without the influence of a threshold voltage deviation.

Also, in the pixel circuit of the OLED display device according to the present invention, the node B (gate) and node C (source) of the driving TFT are initialized using the reference voltage and the initialization voltage, so that the influence of the previous frame can be prevented.

In addition, in the pixel circuit of the OLED display device according to the present invention, in spite of the use of the structure in which only the driving TFT and OLED are connected in series between the high-level voltage line and the low-level voltage line, namely, irrespective of the removal of a conventional light-emission switching TFT, the negative bias is applied to the OLED in the initialization period and threshold voltage detection period to prevent the OLED from emitting light. Therefore, it is possible to suppress an increase in black luminance.

As is apparent from the above description, in a pixel circuit of an OLED display device according to the present invention, the threshold voltage of a driving TFT is detected and compensated for through the use of a storage capacitor connected between the gate and source of the driving TFT. Therefore, an OLED can emit light using current proportional to a difference voltage between a data voltage and a reference voltage without the influence of a threshold voltage deviation.

Also, in the pixel circuit of the OLED display device according to the present invention, the node B (gate) and node C (source) of the driving TFT are initialized using the reference voltage and an initialization voltage, so that the influence of a previous frame can be prevented.

Moreover, in the pixel circuit of the OLED display device according to the present invention, in spite of the use of a structure in which only the driving TFT and OLED are connected in series between a high-level voltage line and a low-level voltage line, namely, irrespective of the removal of a conventional light-emission switching TFT, a negative bias is applied to the OLED in an initialization period and a threshold voltage detection period to prevent the OLED from emitting light, thereby making it possible to suppress an increase in black luminance.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A pixel circuit of an organic light emitting diode display device comprising:

a light emitting element;

a driving thin film transistor (TFT) for driving the light emitting element;

a delivery capacitor connected between a first node and a second node, the second node being connected with the driving TFT;

a storage capacitor connected between the second node and a third node, the third node being connected between the driving TFT and the light emitting element;

a first reset TFT for initializing the first node to a reference voltage in response to a first reset signal from a first reset line;

a second reset TFT for initializing the third node to an initialization voltage in response to the first reset signal from the first reset line;

a third reset TFT for initializing the second node to the reference voltage in response to a second reset signal from a second reset line; and a switching TFT for supplying a data voltage to the first node in response to a scan signal from a scan line, wherein:

in an initialization period, the first to third reset TFTs are turned on to initialize the first and second nodes to the reference voltage and initialize the third node to the initialization voltage, in a threshold voltage detection period, the third reset TFT supplies the reference voltage to the second node such that a voltage at the third node rises through the driving TFT until the storage capacitor detects a threshold voltage of the driving TFT, and in the initialization period and the threshold voltage detection period, the voltage at the third node is lower than a voltage of a cathode of the light emitting element such that a negative bias is applied to the light emitting element, and wherein in the initialization period, the first, second, and third reset TFTs are turned on in response to the first and second reset signals, respectively, and in the threshold voltage detection period, the first and second reset TFTs are turned off in response to the first reset signal, while the third reset TFT remains on.

2. The pixel circuit according to claim 1, wherein:

in a data input period, the delivery capacitor delivers the data voltage, supplied to the first node through the switching TFT, to the second node such that the storage capacitor is charged with a difference voltage between the second node and the third node; and in a light emission period, the driving TFT controls current supplied to the light emitting element based on the voltage charged in the storage capacitor.

3. The pixel circuit according to claim 2, wherein the driving TFT supplies output current thereof to the light emitting element, the output current being proportional to a difference voltage between the data voltage and the reference voltage.

4. The pixel circuit according to claim 1, wherein the second reset TFT is configured to receive the initialization voltage from an initialization voltage source different from ground connected to the light emitting element.

* * * * *